United States Patent [19]

Belinsky

[11] Patent Number: 4,884,521

[45] Date of Patent: Dec. 5, 1989

[54] FAST LOADING ARTICULATED PLATFORMS SYSTEM—FLAPS

[76] Inventor: Sidney I. Belinsky, 40 Waterside Plz. Apt. 14-A, New York, N.Y. 10010

[21] Appl. No.: 41,195

[22] Filed: Apr. 22, 1987

[51] Int. Cl.[4] ..... B63B 3/48

[52] U.S. Cl. ..... 114/72; 114/85

[58] Field of Search ..... 114/72, 75, 76, 78, 114/85; 105/370–372

[56] References Cited

U.S. PATENT DOCUMENTS

| | | | |
|---|---|---|---|
| 3,019,757 | 2/1962 | Bailey | 114/85 |
| 3,380,422 | 4/1968 | Bachko | 114/72 |
| 3,616,776 | 11/1971 | Anker-Nilsen | 114/76 |
| 3,990,383 | 11/1976 | Omote | 114/85 |
| 4,130,075 | 12/1978 | Larive | 114/85 |

*Primary Examiner*—Joseph F. Peters, Jr.
*Assistant Examiner*—Edwin L. Swinehart

[57] ABSTRACT

The Fast Loading Articulated Platforms System—FLAPS provides modern containerships with an ability in a matter of minutes to transform cellular hold, for handling only containers, into multideck hold, for handling outsized and break-bulk cargo, and back to cellular hold. It includes a set of flat moveable deck section, assigned to certain holds, which during a container mode of operation are lowered to the hold bottom and stored on the top of each other, and serve as a foundation for several layers of containers above them. During the general cargo mode of operation, the moveable deck section are lifted above each other to a certain height and are fixed to the ship's structure. It transforms cellular hold into multideck hold. Each moveable deck section has a provision to be pivoted 90° in the hold and stored in this position during cargohandling operation on the lower deck.

9 Claims, 16 Drawing Sheets

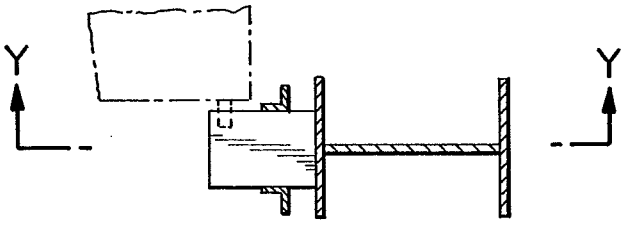
FIG. 40
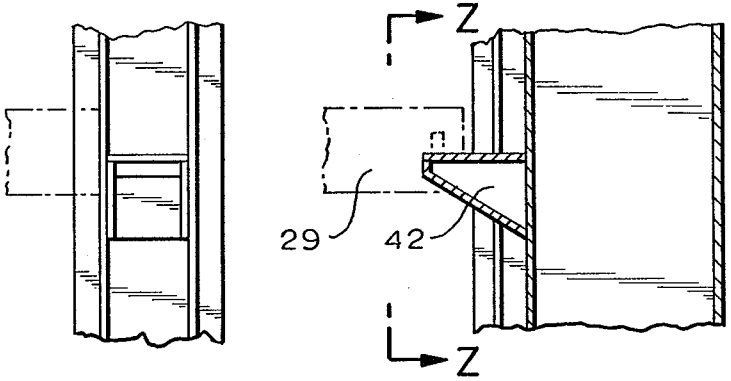
FIG. 41
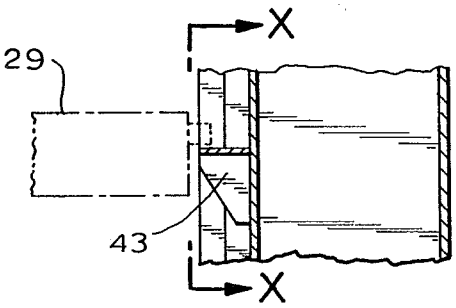
FIG. 38
FIG. 42
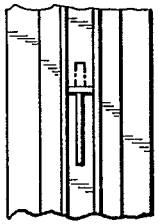
FIG. 39
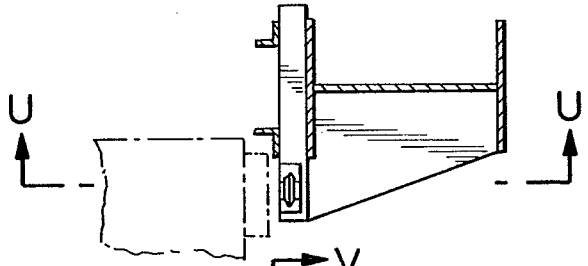
FIG. 34
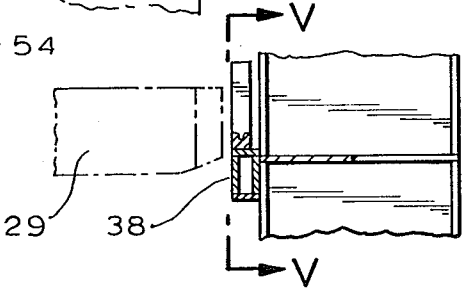
FIG. 35
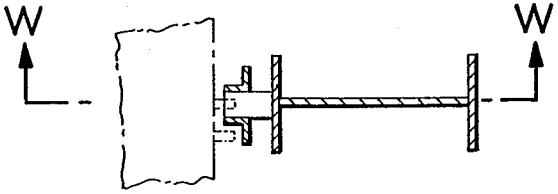
FIG. 37
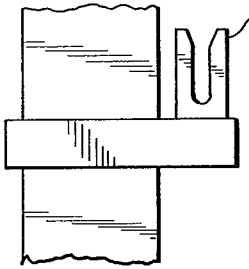
FIG. 36

FAST LOADING ARTICULATED PLATFORMS SYSTEM—FLAPS

This invention relates to the Maritime Idustry and particularly to the containership's ability to transport cargo other than containers.

BACKGROUND

Modern containerships sometimes have the need to transport outsized and break-bulk cargo which does not fit into standard containers.

From prior art it is known that many solutions have been attempted in order to satisfy this need, almost all of them failed to achieve this goal. Presently only FlatRacks and gigantic containers named SeaShed are in limited use.

The main drawback of SeaSheds used for containership operations is the considerable loss is ship's container capacity which is equal to the full volume of SeaSheds when they are left in the hold, and the ship is back to exclusive container handling mode of operation. Among the other SeaShed disadvantages are the reduction in work-thru opening by 40% and high initial and maintenance cost.

The main drawback of the FlatRacks used for containership operations is also the substantial loss in ship's container capacity (one container for each two Flatracks left in the cellular hold). Comparative with SeaSheds, the FlatRacks require considerable additional handling during the general cargo mode of operation. Each time an access to the lower level is required all FlatRacks have to be removed from the hold and storred in some place. Besides complicating the cargo handling operation, this increases ship loading or unloading time.

The portable cargo deck described by U.S. Pat. No. 4,130,075, in comparison with SeaSheds and FlatRacks, requires much less space in order to be stored in the ship hold, however, it has the same drawback as the FlatRack in handling. The patented portable cargo deck also has to be removed from the hold each time access to lower deck is required.

Additional serious drawback of this portable deck is the need for a special hoisting device to lift and operate it. This limits its wide use to a few designated lines.

SUMMARY OF THE INVENTION

The object of this invention is to provide the containership with a system, for transformation of its cellular hold into a multideck hold and then back to a cellular hold in a matter of minutes, and which in stored position will occupy only a fraction of the hold space.

The main innovation of the Fast Loading Articulated Platforms System—FLAPS, is in the utilization of special moveable deck section, and in the the way how they operate, in a group, when are placed in the hold during a multideck general cargo mode of operation and during a container mode of operation.

Specifics in the design of the movable deck section enables the Fast Loading Articulated Platforms System—FLAPS to:

lower the movable deck section into the cellular hold section using container guides;

fix the moveable deck sections in the hold at various heights;

provide an access to the hold bottom by rotating the moveable deck sections 90° and to fix them in this position;

accomodate the containers above the moveable deck sections stored on the hold bottom during a ship's container mode of operation;

store movable deck sections on the hold bottom by stacking them one on top of the other and by restricting their horizontal movement.

Detailed innovations of the movable deck sections are in the design of:

throw-out guides, imitating container's corners, throw-out vertical support transmitting weight forces, throw-out pivot assemblies which simultaneously are restricting horizontal movement of the moveable deck section, throw-out latch and stopper arrangement, which are fixing the moveable deck section in a vertical position in an automated mode utilizing gravity forces.

BRIEF DESCRIPTION OF THE DRAWINGS

FIG. 34 is a detail A from FIG. 4.

FIG. 35 is a section U—U from FIG. 34.

FIG. 36 is a section V—V from FIG. 35.

FIG. 37 is a detail B from FIG. 4.

FIG. 38 is a section W—W from FIG. 37.

FIG. 39 is a section X—X from FIG. 38.

FIG. 40 is a detail C from FIG. 4.

FIG. 41 is a section Y—Y from FIG. 40.

FIG. 42 is a section Z—Z from FIG. 41.

DETAILED DESCRIPTION

General

Figure 7:
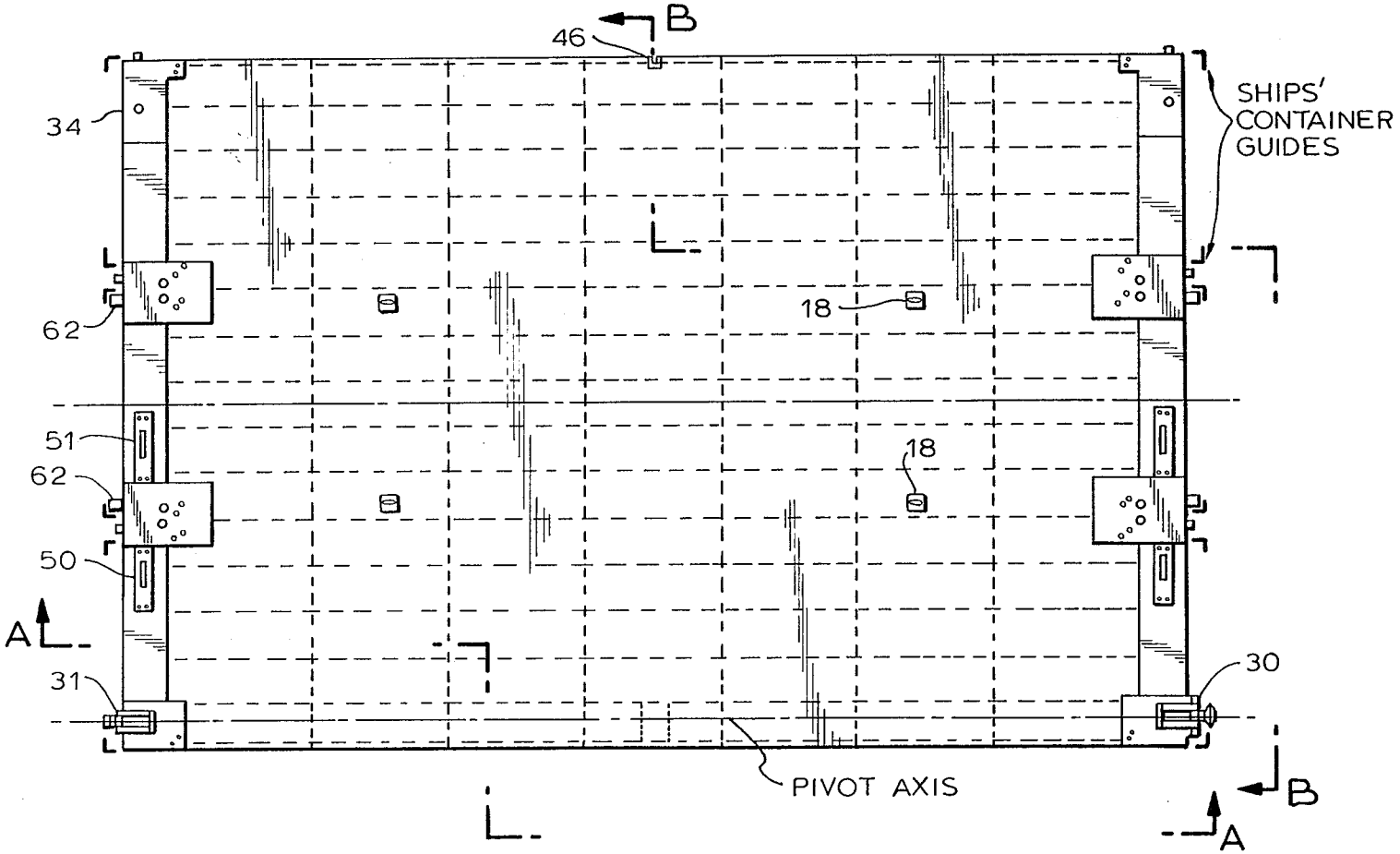
FIG. 7 is a plan of a moveable deck section.
Figure 8:
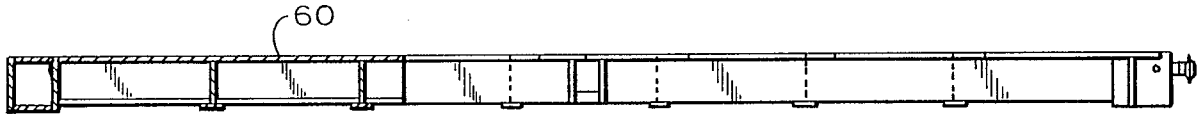
FIG. 8 is an elevation A—A of a moveable deck section.
Figure 10:
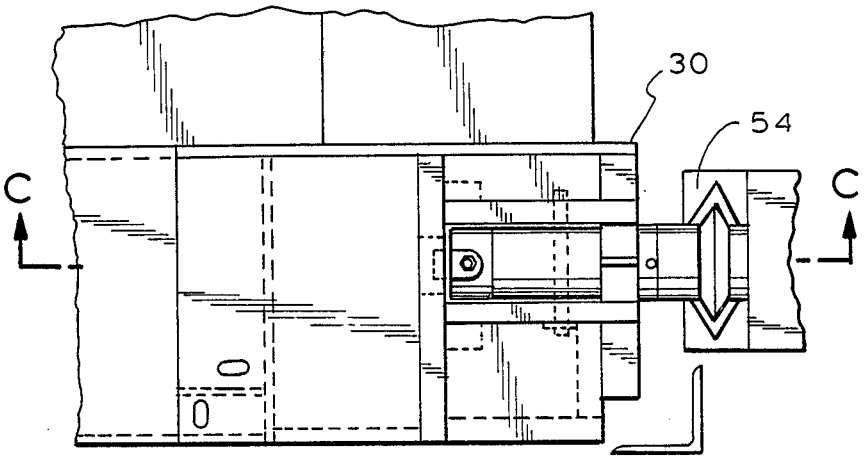
FIG. 10 shows a plan of a pivot throw-out dog with thrust ring.

Referring to FIG. 1 through FIG. 5 the FLAPS 20 is shown installed in hold 8 on the containership 22. The FLAPS 20 includes cellular section of containership, for three containers in a row and six stacked-up, and three moveable deck sections: upper 24, intermediate 26, and lower 28. Each moveable deck section 29 (FIGS. 7; 8; and 9) has two pivot throw-out dogs 30 and 31. One of them, 30, has an ability to accomodate longitudinal force acting on the portable deck. These pivot throw-out dogs are resting on a two pivot bearers 38 and 39, which are incorporated into the hold structure. One of them, 38, fits with throw-out dog 30 and is able to accomodate and restrict longitudinal force acting on the moveable deck section and the longitudinal movement of this portable deck.

Each moveable deck section 29 also has two corner throw-out dogs 34, which are resting on corner bearers 42 incorporated into the hold structure.

Each portable deck 29 has four intermediate supports 62. These supports are resting on intermediate bearers 43, incorporated with container guides and hold structures.

Each moveable deck section 29 has two latch arrangements 50, which interact with the hook 52 incorporated with the hold structure.

Each moveable deck section 29 has two stopper arrangements 51, which interact with the thrust plate 53 incorporated with the hold structure.

Each portable deck 29 has a lifting arrangement 46, which is activated by hoisting line 44.

Each moveable deck section 29 has a hoisting arrangement 18 which consists of four flush deck sockets welded into the portable deck. The distance between them will permit the use of a standard 20 ft container spreader for lifting the portable deck or four sling arrangements with a crane hook.

Figure 6:
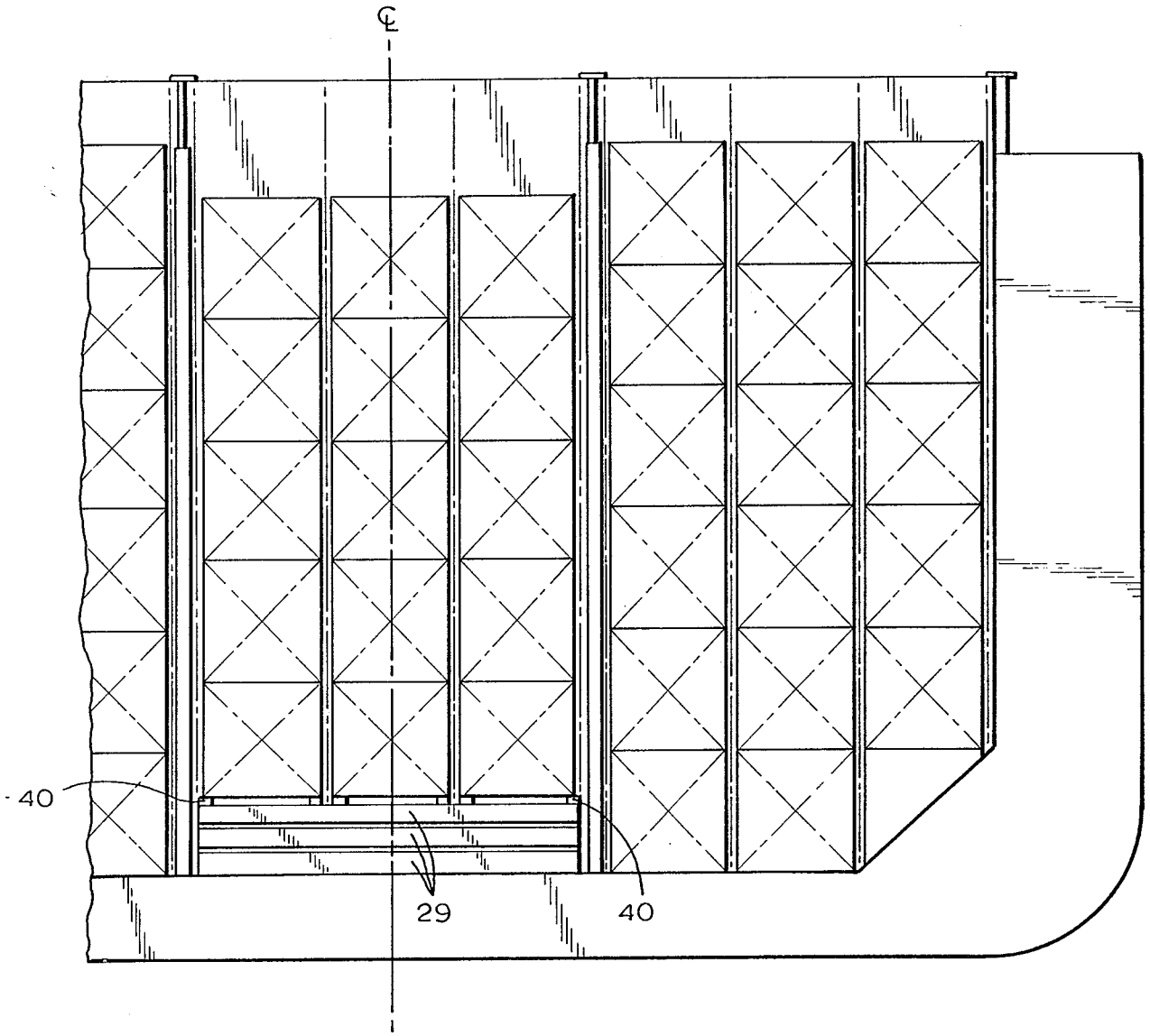
FIG. 6 is a section through a hold whose center part contains on its bottom three moveable deck sections stored above each other, and containers stored above them.
Figure 9:
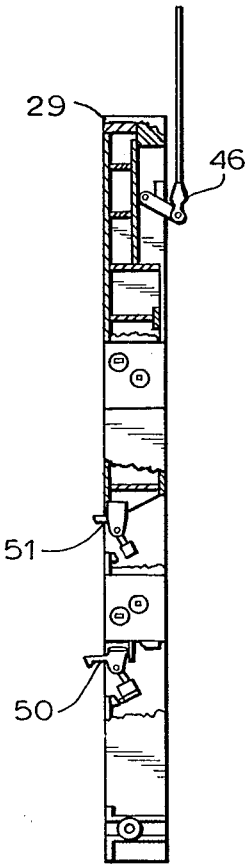
FIG. 9 is a side view B—B of a moveable deck section.

During ship container mode of operation, when all three moveable deck sections are on the hold bottom (FIG. 6) a set of twelve portable container corner supports 40 will be used to interconnect the containers with the upper moveable deck section.

Location of the moveable deck section bearers

According to the vertical location of the moveable deck sections in the hold the three sets of bearers supporting each moveable deck section will be mounted on the hold structure on three different levels. In addition, three sets of only pivot bearers 30 and 31 will be mounted on the lower part of the hold structure to prevent the stored moveable deck sections from horizontal movement.

Main assemblies

1. A pivot throw-out dog 30 (FIGS. 10 through 13) consists of a welded body 68 incorporated into frame 60; an elongated bar 64 having one end in a form of a cylindrical pin 66, on the outer end of which is located thrust ring 67. The other part of bar 64 has a rectangular section which is restrained between two vertical plates incorporated into body 68. Upper cross bar 70 and lower cross bar 71 are designed to accomodate vertical forces acting on bar 64. Bar 70 has a cut-out able to accomodate an inclined beard 65 on the bar 64. The cross plate 72 restricts inward horizontal movement of bar 64. Combined action beard 65, bar 70 and bar 71 prevents bar 64 from outward horizontal movement. The pivot pin 73, due to a gap between it and an opening in bar 64, does not participate in the distribution of the forces acting on bar 64. Pivot pin 73 is located some distance off the center of gravity of bar 64 thus providing that bar 64 will be normally in a vertical position inside the envelope dimentions of the platform. Activating bar 64 into a working position will be done by string 75 connected to ear 76. Fixing bar 64 into a working position will be done by check stopper 77.

Centering moveable deck section 29 with the ship's structure in a longitudinal direction is done by means of thrust ring 67, which has the shape of a double cone, and of the vertical guiding plate 54. Guiding plate 54 is a part of pivot bearer 38 which is incorporated into the ship structure, has a vertical elongated cut-out with a V-type groove along this cut-out which serves as a directing guide during vertical movement and as a means of restraint of the longitudinal horizontal movement.

Figure 16:
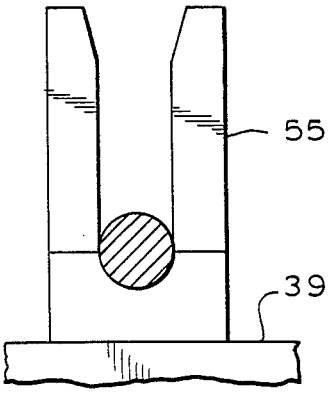
FIG. 16 is a section G—G from FIG. 15.
Figure 14:
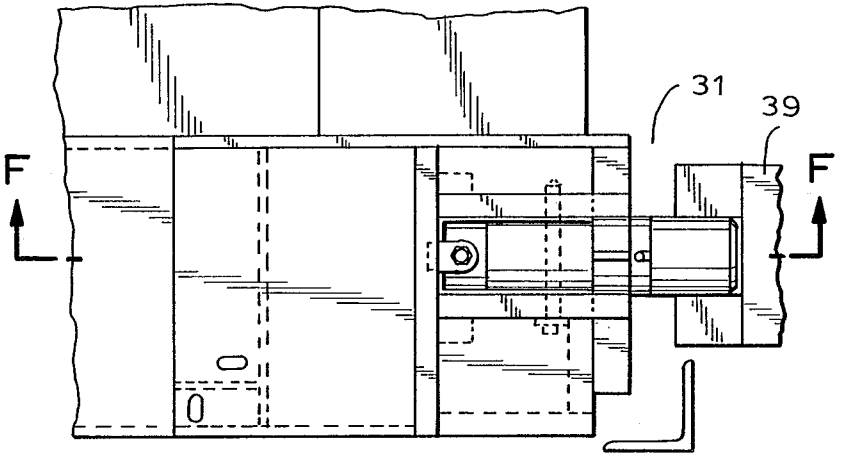
FIG. 14 shows a plan of a pivot throw-out dog without thrust ring.
Figure 15:
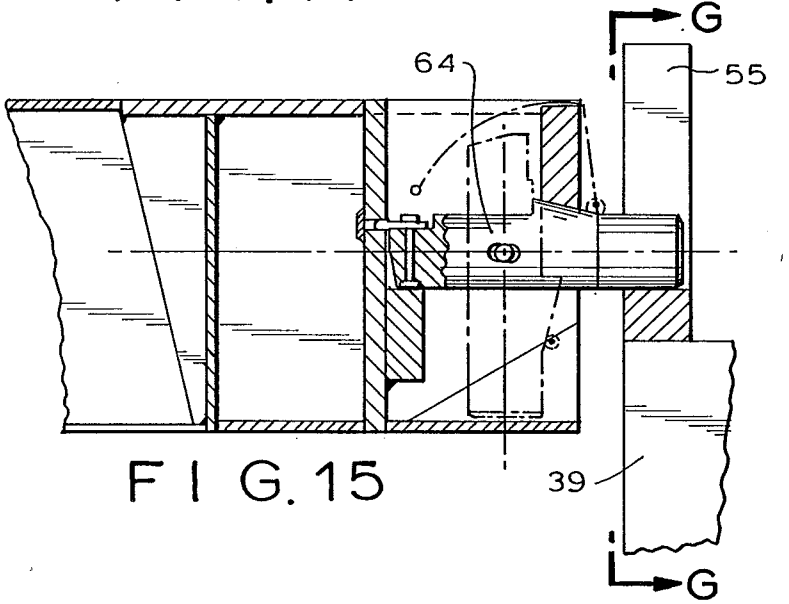
FIG. 15 is a section F—F from FIG. 14.

2. Pivot throw-out dog 31 (FIGS. 14 through 16) is similar to support 30. The difference is that support 31 does not have the restriction of lateral horizontal movement. The elongated bar 64′ does not have the thrust ring 47 and guiding plate 55 does not have the V-type groove along its elongated cut-out.

Figure 19:
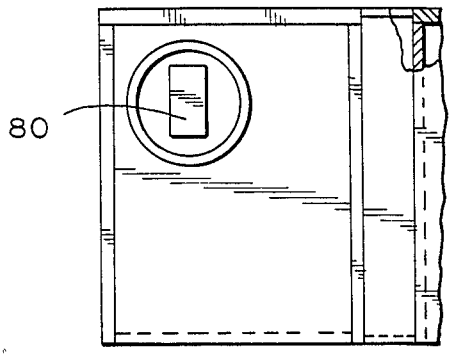
FIG. 19 is a view K—K from FIG. 18.
Figure 17:
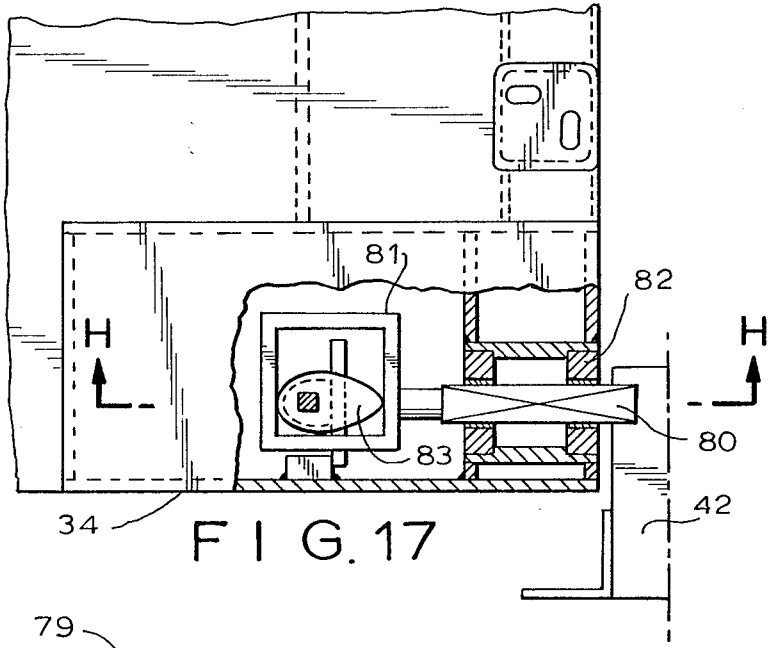
FIG. 17 shows a plan of a corner throw-out dog.
Figure 18:
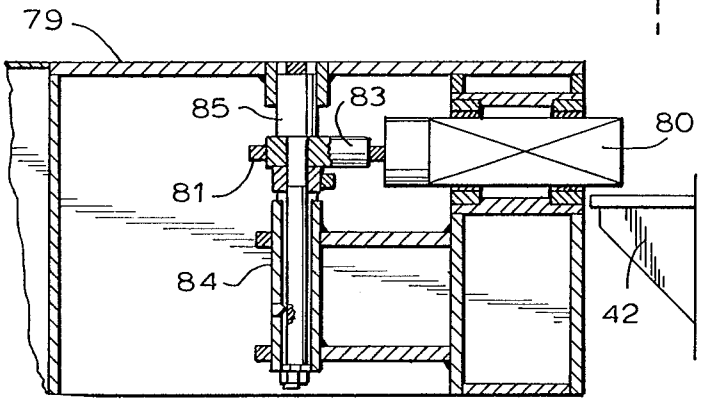
FIG. 18 is a section H—H from FIG. 17.
Figure 22:
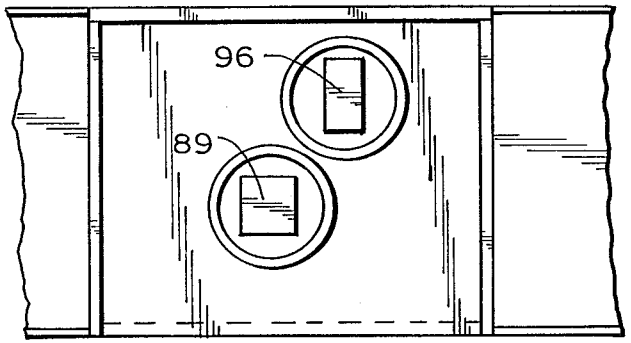
FIG. 22 is a view M—M from FIG. 21.
Figure 23:
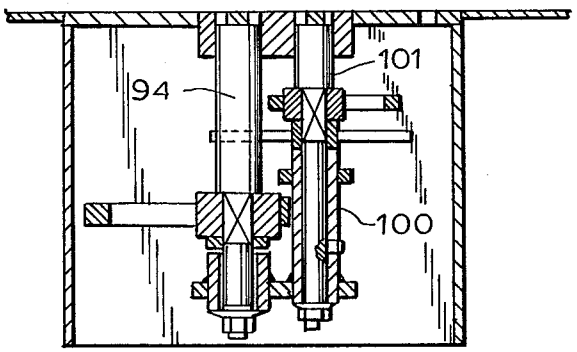
FIG. 23 is a section N—N from FIG. 21.
Figure 20:
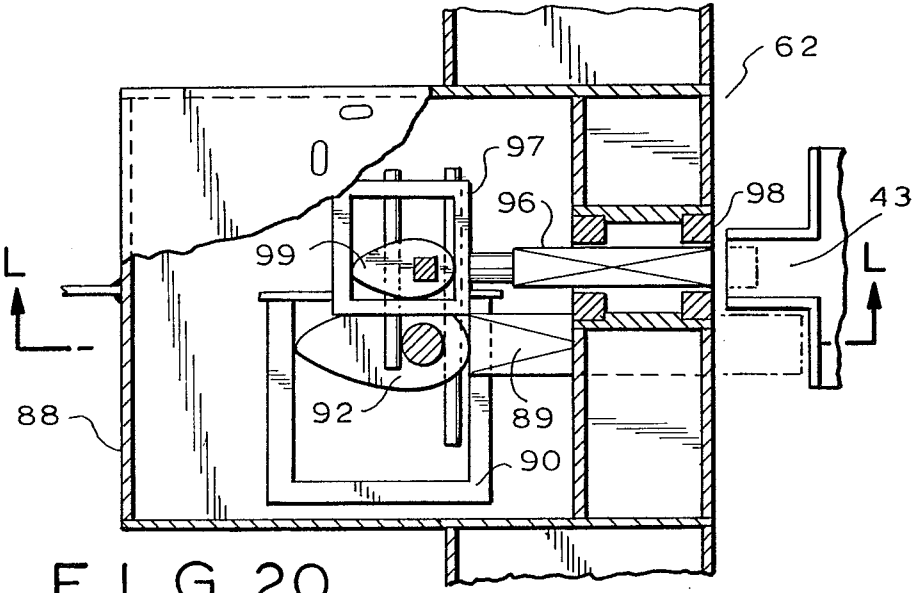
FIG. 20 shows a plan of an intermediate support.
Figure 21:
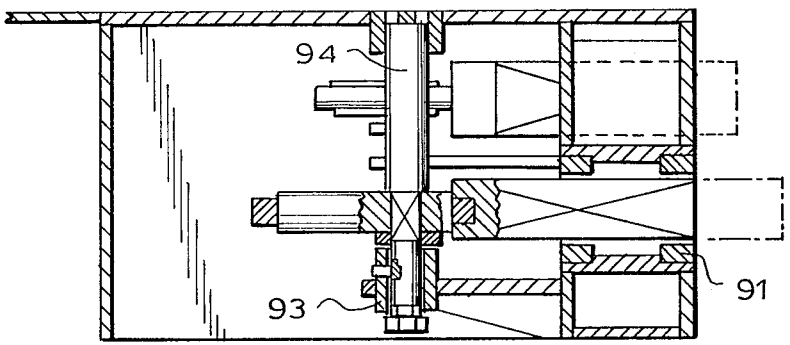
FIG. 21 is a section L—L from FIG. 20.

3. Corner throw-out dog 34 (FIGS. 17 through 19) consists of body 79 which is incorporated into frame 60, supporting bar 80 connected to cam-cage 81, rectangular bearings 82, cam 83, bearing arrangement 84 and cam-shaft 85. Rectangular bar 80 during operation is resting on corner bearer 42, which is interconnected with the ship structure and container guides.

4. Intermediate support 62 (FIGS. 20 through 23) consists of welded body 88 incorporated into frame 60, guiding bar 89 connected to cam-cage 90, rectangular bearing 91, cam 92, bearing arrangement 93 and cam-shaft 94. Supporting bar 96 connected to cam-cage 97, rectangular bearing 98, cam 99, bearing arrangement 100 and cam-shaft 101. Supporting bar 96, during operation, is resting on an intermediate bearer 43 incorporated with the container's guides.

Figure 25:
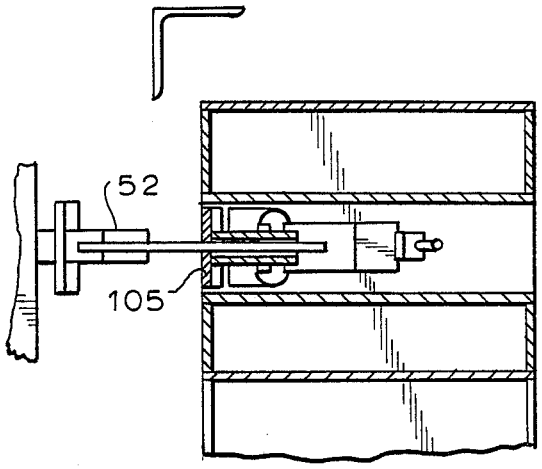
FIG. 25 is a section O—O from FIG. 24.
Figure 24:
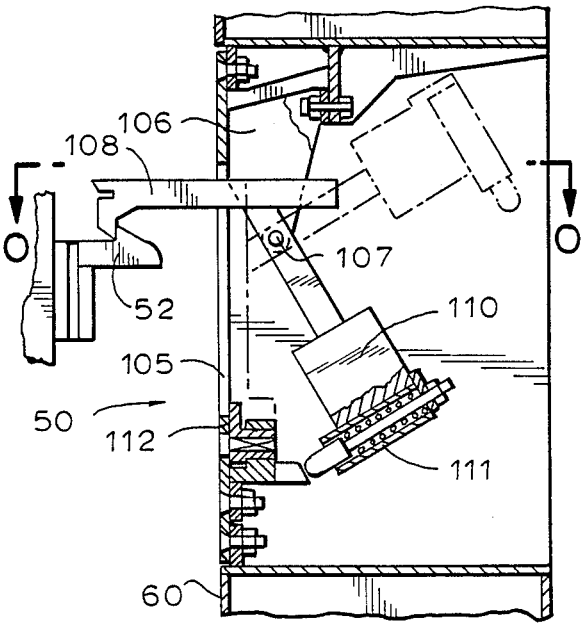
FIG. 24 shows a latch arrangement of a moveable deck section engaged with a hook on the ship structure.

5. Latch arrangement 50 (FIG. 24 and FIG. 25) consists of base 105 which is bolted to frame 60, fulcrum bracket 106, pivot pin 107, latch bar 108, counterweight 110, spring compensator 111, latch bar arrester 112. FIG. 24 shows platform 29 in a vertical position and latch bar 108 engaged with hook 52 incorporated with ship structure.

Figure 27:
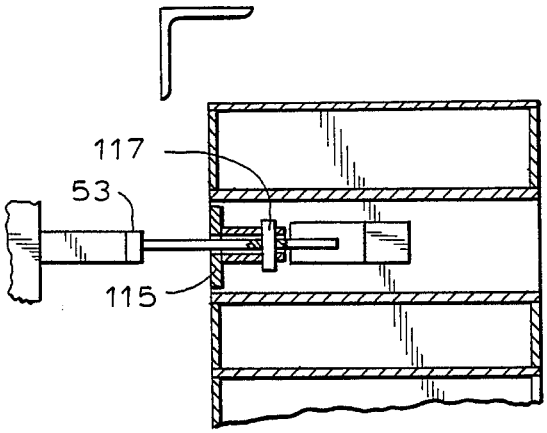
FIG. 27 is a section P—P from FIG. 26.
Figure 26:
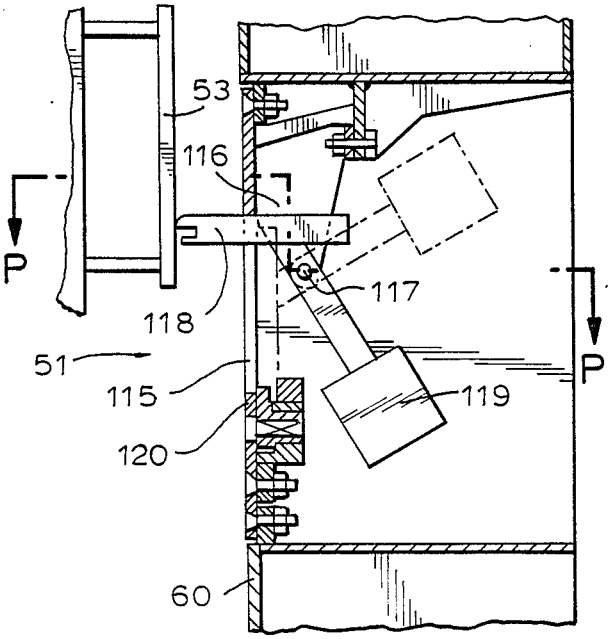
FIG. 26 shows a stopper arrangement of a moveable deck section in contact with a thrust plate on the ship structure.

6. A stopper arrangement 51 (FIGS. 26 and 27) consists of base 115, which is bolted to frame 60, fulcrum bracket 116, pivot pin 117, stopper bar 118, counterweight 119 and stopper bar arrester 120. FIG. 26 shows moveable deck section 29 in a vertical position and stopper bar 118 in contact with thrust plate 53 which is incorporated into the ship structure.

Figure 29:
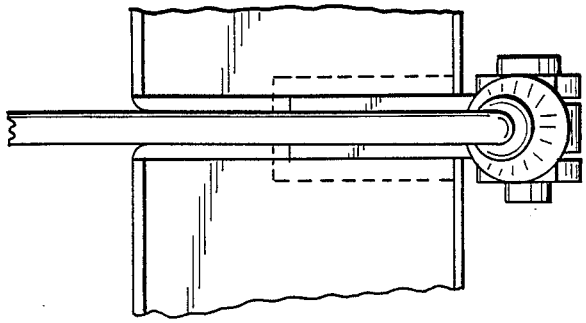
FIG. 29 is a section S—S from FIG. 28.
Figure 28:
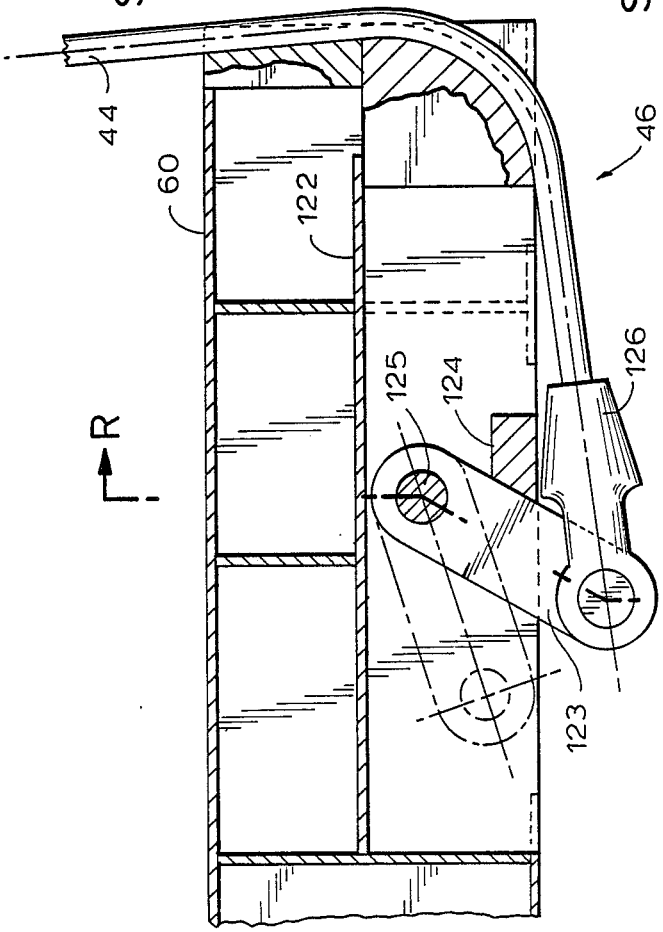
FIG. 28 shows a lifting gear arrangement.
Figure 30:
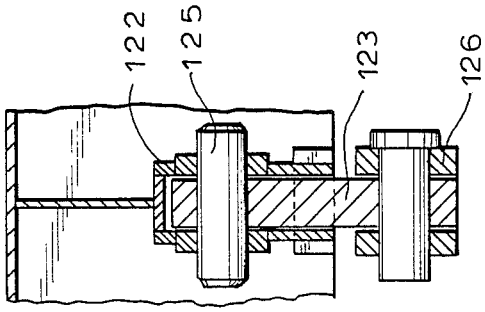
FIG. 30 is a section R—R from FIG. 28.

7. A lifting gear arrangement 46 (FIGS. 28 through 30) consists of welded body 122 incorporated into frame 60, pivotal bracket 123, thrust bar 124, pivot pin 125, socket 126 and wire rope 44.

Figure 31:
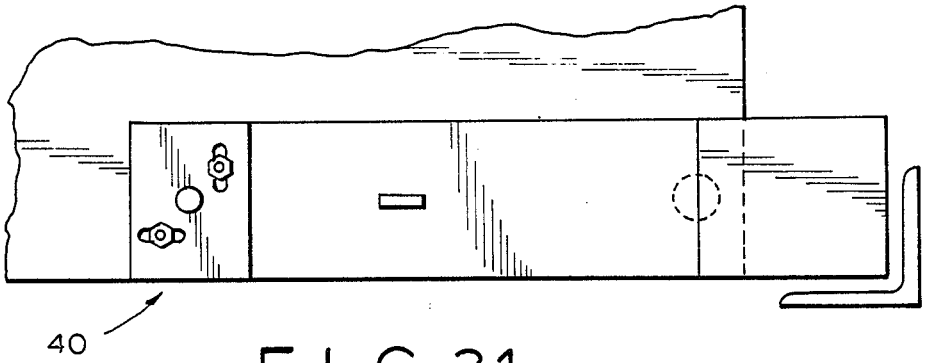
FIG. 31 shows a plan of a portable container's corner support.
Figure 33:
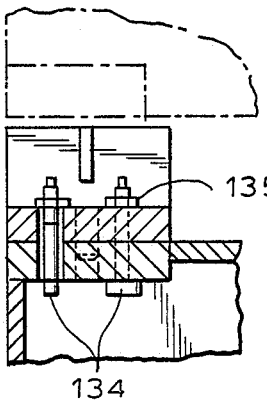
FIG. 33 is a section T—T from FIG. 32.
Figure 32:
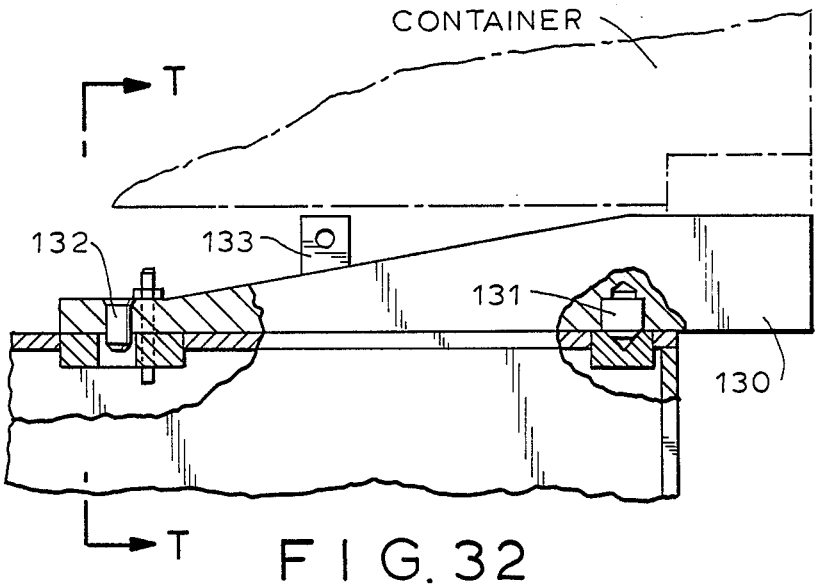
FIG. 32 is an elevation of the portable container corner support.
Figure 44:
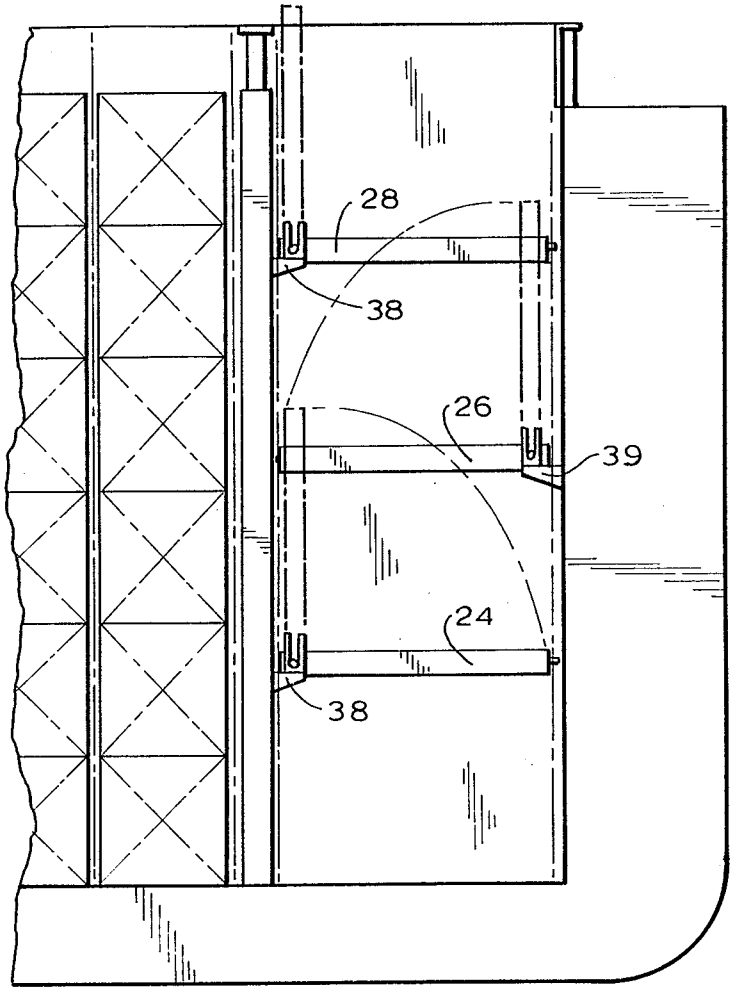
FIG. 44 is a section through a hold with two containers in a row.
Figure 43:
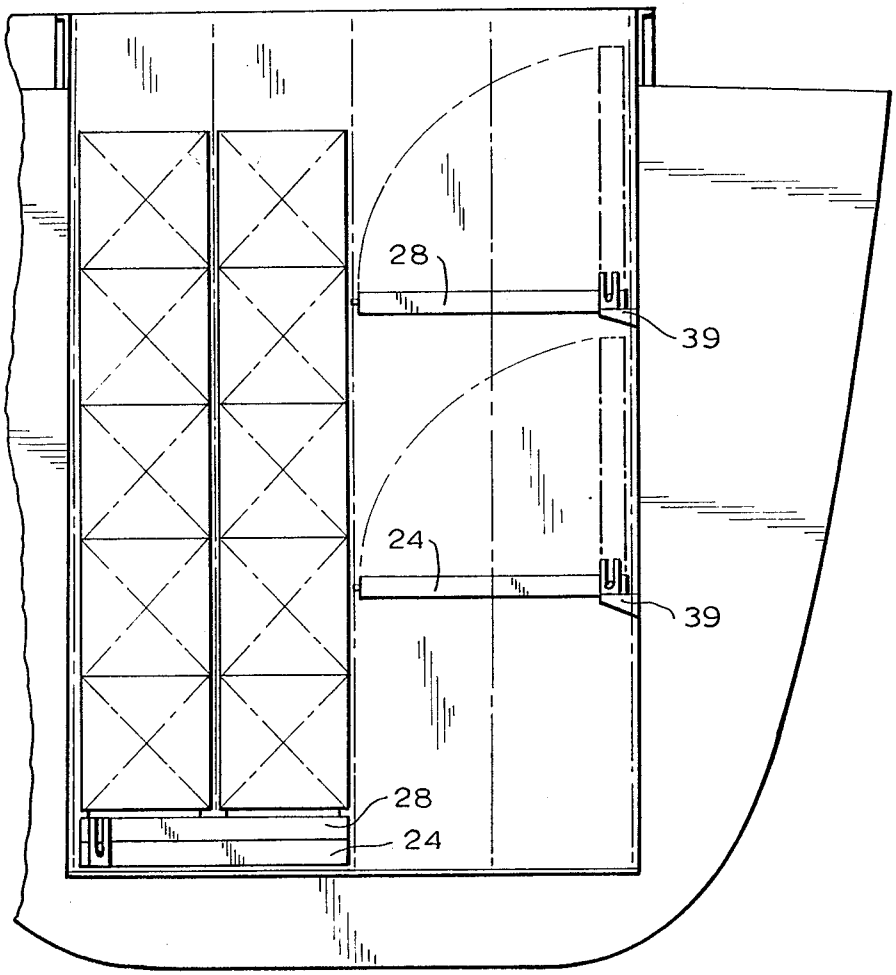
FIG. 43 is a section through a hold with four containers in a row.

8. Portable container's corner support 40 (FIGS. 31 through 33) consists of body 130, conical stopper 131, cylindrical stopper 132, lifting ear 133 and a pair of special T-head bolts 134 with nuts 135.

Transformation from a storred mode to a four-deck hold arrangement

Figure 1:
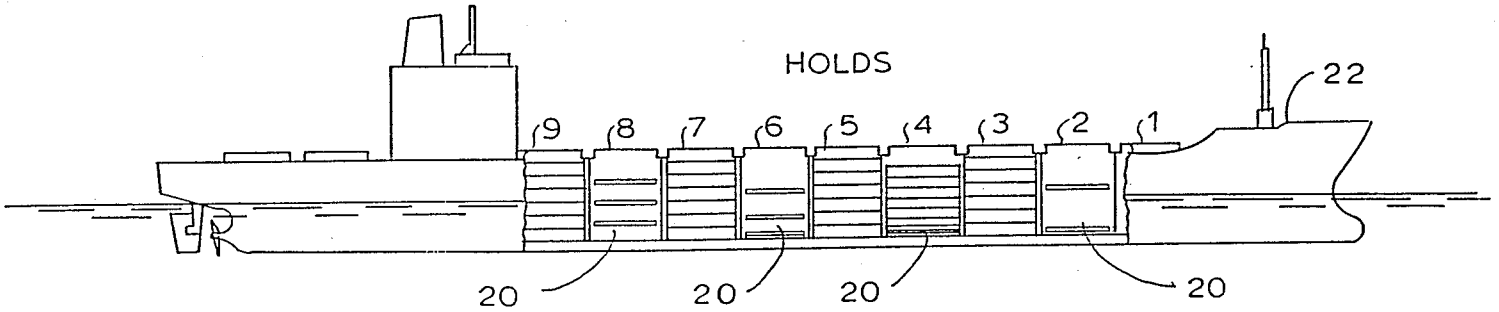
FIG. 1 is a general arrangement showing several alternatives of the Fast Loading Articulated Platforms System—FLAPS employed in holds.
Figure 2:
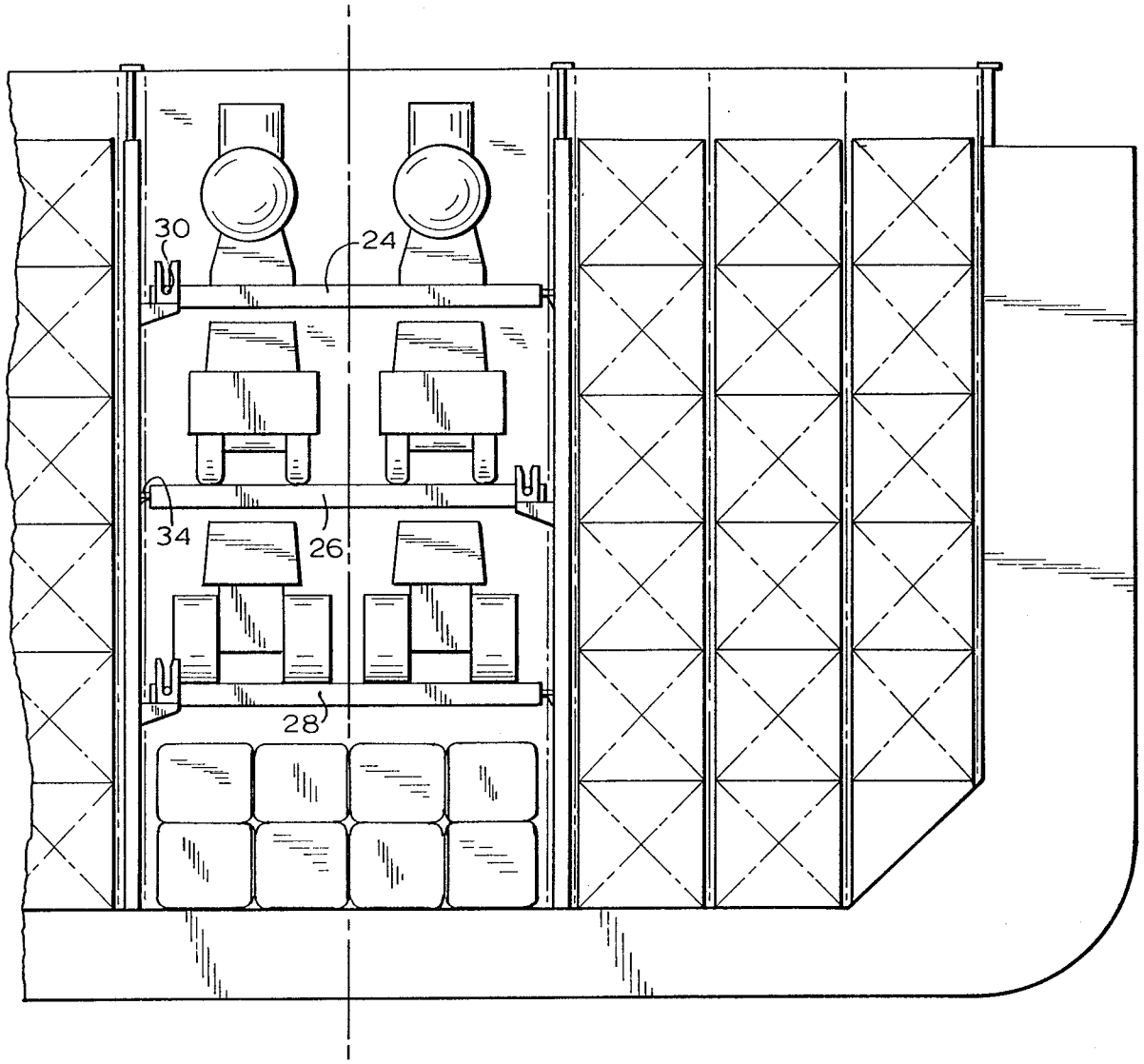
FIG. 2 is a section through a hold with three containers in a row and whose center part is transformed to handle outsized cargo on four decks.
Figure 3:
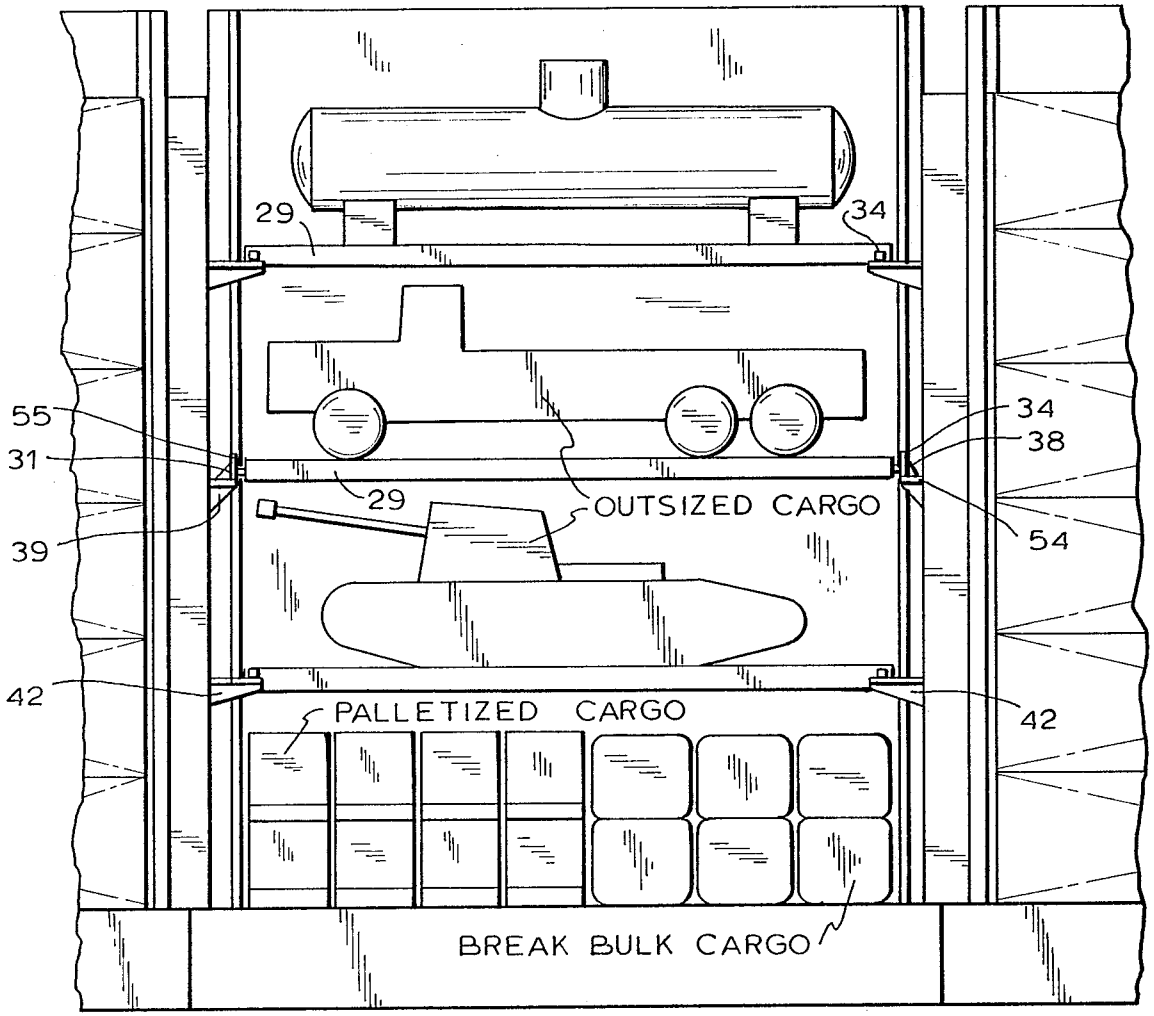
FIG. 3 is an elevation through a center part of a hold which is transformed to handle outsized cargo on four decks.
Figure 4:
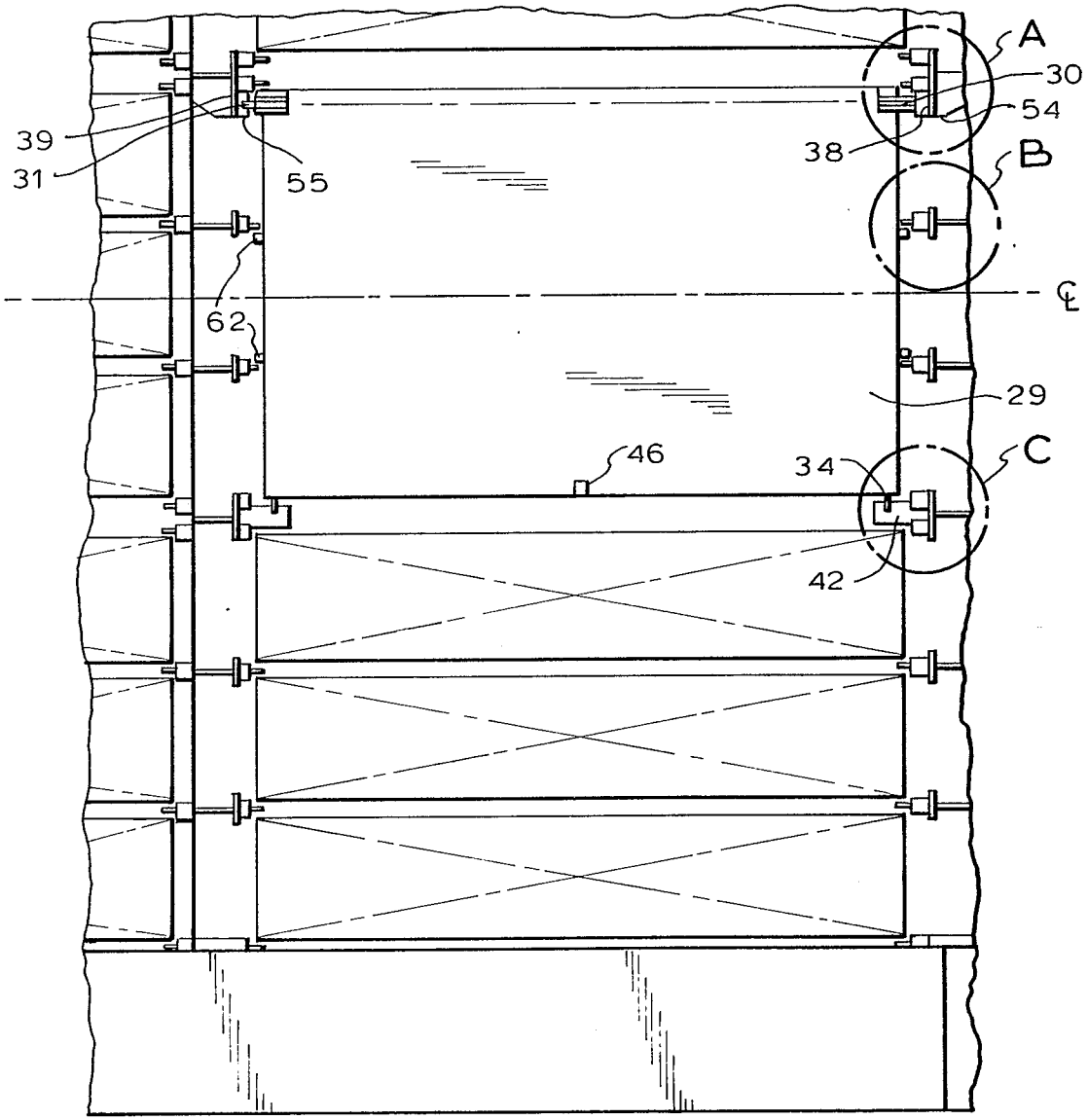
FIG. 4 is a plan of a moveable deck section installed in a center part of the hold.
Figure 5:
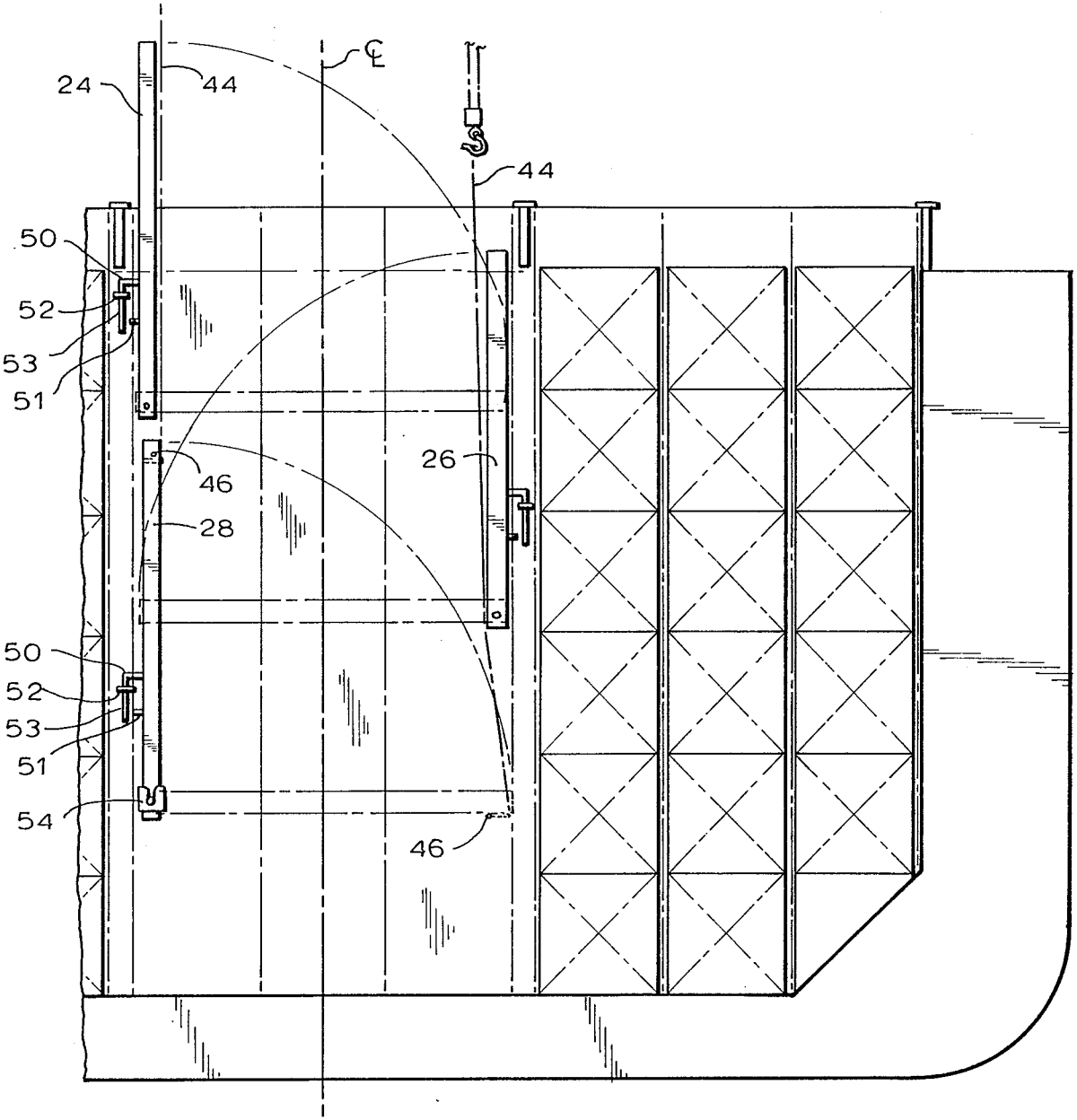
FIG. 5 is a section through a hold where three moveable deck sections are in a position pivoted 90°.

Moveable deck section in the stored mode are shown in FIG. 5. In this mode lower moveable deck section 28 is placed on the ship bottom deck. Intermediate moveable deck section 26 is placed above the lower moveable deck section 28 and upper movable deck section 24 is placed above the intermediate moveable deck section 26. Horizontal movement of the moveable deck section 24; 26 and 28 are restricted by actuated throw-out guiding bars 89.

The transformation operation is performed in the following sequence:

Removing container's corner supports 40 from the upper deck 24. This operation will be done by the operator and will include releasing and rotating T-head bolt 139 on a 90° to match the elongated slot, lifting supports 40 through ear 133 and storring them on a special arrangement.

Lifting upper moveable deck section 24 by a crane hook and four slings or by a 20-ft container spreader slightly above its stored position until the elongated bars 64 will be out of contact with the guiding plates 54 and 55.

The operator standing on the moveable deck section disengages pivot throw-out dogs 30 and 31 from contact with the ship structure. This is done by turning check stopper 77 and letting the elongated bars 64 return to the vertical position under the force of gravity.

Lifting upper deck 24 by crane slightly above its stationary position.

Reactivating pivot throw-out dogs 30 and 31 into working mode by lifting them from the vertical position to a horizontal position by string 75 and to fix them in this position by check stoppers 77.

Reactivating the corner throw-out supports 34 into working mode. This is done by turning cam-shaft 85 180°, which pushes rectangular bar 80 out of box 79.

Lowering upper moveable deck section 24 to its stationary position, where it will be rested on four points formed by pivot throw-out dogs 30, 31 and corner throw-out dogs 34.

Disconnecting four slings and a crane hook from the deck.

Connecting hoist line 44 to a crane hook and lowering the hoist line socket 126 to a position where it could be connected to the lifting gear arrangement 46.

Retracting guiding bars 89 of the intermediate support 62 from a working mode into the stored mode. This is done by turning cam-shaft 94 180°, which pulls bar 89 into body 88.

Lifting one end of portable deck 24 a few inches by hoist line 44.

Retracting corner throw-out dogs 34 from working mode into the stored mode. This is done by turning cam-shaft 85 180°, which pulls the rectangular bar 80 into box 79.

Activating latch arrangements 50 and stopper arrangements 51 by releasing latch bars 108 and stopper bars 118 by turning arresters 112 and 120.

Rotating moveable deck section 24 90° by hoist line 44.

Arresting moveable deck section 24 in a vertical position. This operation is performed automatically due to the latch arrangements which prevent moveable deck section 24 from a turning in backward position, and whose locking ability is based on the force of gravity. Moveable deck section 24 is limited to a 90° rotation by a stopper arrangement which is also based on the utilization of the force of gravity.

After upper moveable deck section 24 is arrested in its vertical position, intermediate moveable deck section 26 and lower moveable deck section 28 will be lifted to their stationary position and arrested in a vertical position in the same manner as moveable deck section 24. After the cargo is loaded on to the ship bottom moveable deck section, lower deck 28 will be pivoted to a horizontal position.

This operation will be done in the following sequence:

Connecting hoist line 44 with a crane hook.

Figure 11:
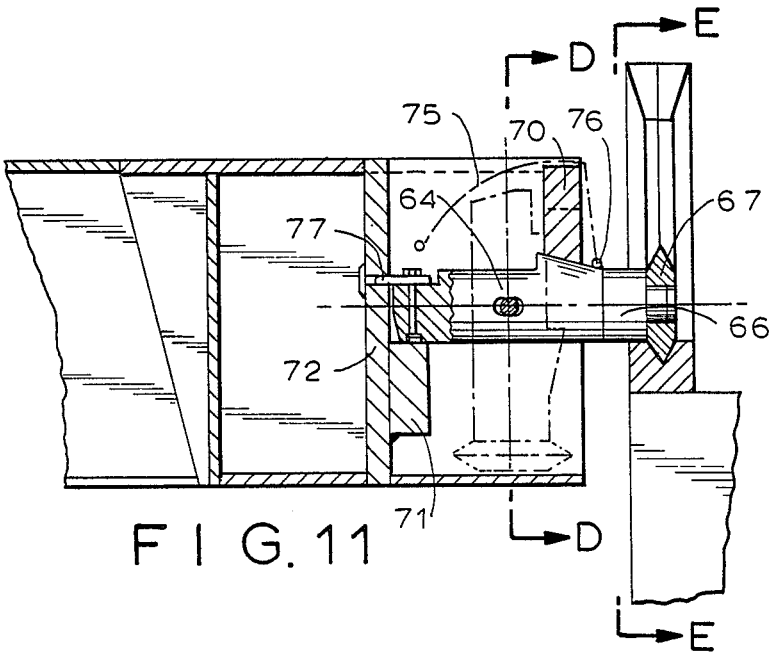
FIG. 11 is a section C—C from FIG. 10.
Figure 12:
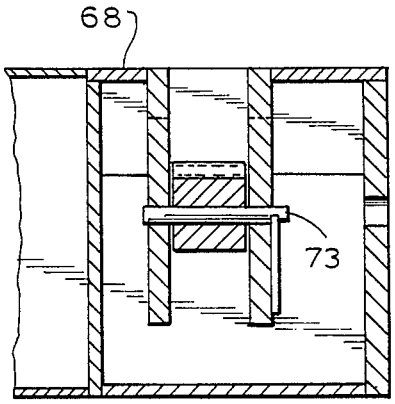
FIG. 12 is a section D—D from FIG. 11.
Figure 13:
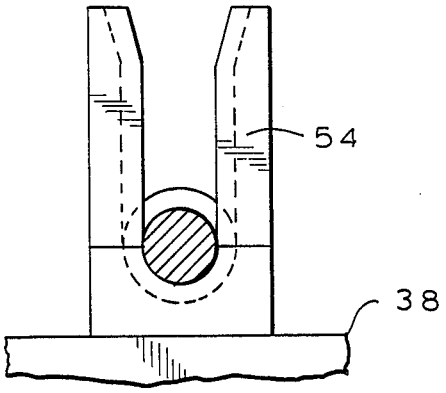
FIG. 13 is a section E—E from FIG. 11.

Lifting moveable deck section 28 about two inches. As a result of this lift the tooth of latch bar 108 will go out from contact with the tooth of hook 52 (FIG. 24). At the same time cylindrical part 66 of the elongated bar 64 will still be in the vertical elongated cut-out of plates 54 and 55. Although it will be lifted from the bearing base (FIGS. 11 and 13).

Shifting the upper end of moveable deck section 28 a few inches in the horizontal direction. This operation will be done by the crane operator by slightly inclining the hoisting line.

Lowering moveable deck section 28 to its initial horizontal position. Since the moveable deck section will be slightly off the vertical position, the tooth of latch bar 108 will not come into engagement with hook 52. Thus permiting further rotation of moveable deck section 28 in a backward direction.

Lowering moveable deck section 28 to an almost horizontal position.

Operator comes on the moveable deck section and reactivates all the throw-out supports and guides into working mode.

Lowering moveable deck section 28 to its stationary position until it rests on all eight throw-out dogs.

Disconnecting the hoist line from the crane hook and storing it on moveable deck section 28 level without disconnecting it from gear arrangement 46.

After the cargo is loaded onto lower moveable deck section 28 the intermediate moveable deck section 26 will be lowered to the horizontal position in the same manner as the lower moveable deck section was lowered.

Similarly, upper moveable deck section 24 will be lowered to the horizontal position after the intermediate moveable deck section is loaded.

Transformation from a four-deck arrangement to a stored mode will be done in a backward order.

What is claimed is:

1. A fast loading articulated platform system for rapid conversion of a containership's cellular hold into a multi-deck arrangement for handling general cargo, comprising:

a section of the containership's cellular hold containing a set of moveable deck sections, oriented vertically one above the other, and a set of bearers, to fix the vertical position of said moveable deck sections on different levels and to transfer forces from said moveable deck sections to the containership's main structural elements;

means for rapid connection between said moveable deck sections and said bearers:

means for guiding vertical movement of said moveable deck sections along the entire height of said cellular hold;

means for providing vertical access to the movable deck section located below other said moveable deck sections by pivoting each said other moveable deck section about one of its edges to a vertical position and storing each said other movable deck section in said vertical position, said moveable deck sections having a width larger than the height between adjacent movable deck sections, and means for securing said pivoted moveable deck sections in said vertical position;

means for accommodating containers above said moveable deck sections, when they are stored one on top of each other on the containership's hold bottom.

2. The system of claim 1, wherein said means for rapid connection comprises:

a set of pivotal means on opposite ends of said moveable deck sections;

said pivotal means comprising two pivot throw-out dogs located on said opposite ends of said movable deck sections, said throw-out dogs having an end with a cylindrical pin with a longitudinal axis in common with a pivot axis of said moveable deck section, said pivot axis being oriented along longer sides of said movable deck sections, said pivot throw-out dogs serving as a means of restricting said moveable deck sections horizontal movement in a lateral direction, wherein one of said cylindrical pins is attached to a thrust ring thereby restricting horizontal movement of said moveable deck sections in a longitudinal directon;

two corner throw-out dogs located on said longer sides of said movable deck sections, opposite said pivot throw-out dogs, each of said corner throw-out dogs having an end with a rectangular bar with a lower flat surface vertically supporting said moveable deck sections;

four intermediate supports grouped in pairs, and located along shorter sides of said movable deck section and symmetrically about a longitudinal axis of said moveable deck section, each of said intermediate supports comprising a throw-out dog with an end including a rectangular bar with a flat surface vertically supporting said moveable deck section and a throw-out guide including an end with a square bar contacting a vertical container guide system and vertically guiding said moveable deck section inside the vertical container guide system;

two latching means oppositely located on said shorter sides of said moveable deck section, each latching means comprising a throw-out latch bar with a counterweight to maintain said moveable deck section in a vertical position and to prevent rotation thereof;

two stopper means oppositely located on said shorter sides of said moveable deck section, each of said stopper means compromising a throw-out stopper bar and a throw-out counterweight functioning to limit rotation of said platform to an acute angle;

a lifting means located in the middle area of said moveable deck section, on a side opposite to said pivot axis, said lifting means including a line with a socket through which said line is connected to a pivotal bracket, said lifting means thereby being capable of rotating said movable deck section; and a hoisting means comprising four flush deck sockets welded into said moveable deck section symmetrically to major and minor axes of said moveable deck section, said hoisting means thereby being capable of lifting said moveable deck section by a 20-foot standard container spreader and a crane hook with at least four slings.

3. The system of claim 2 further comprising, each of said sets of bearers comprising:

two pivot bearers located on opposite sides of the cellular hold section, each comprising an axis of rotation along a common line thereby forming a pivot axis for the respective moveable deck section, a vertical plate with a vertical elongated cut-out portion with a funnelshape on its upper section and a semicircular opening on its lower section, and a base, wherein said vertical plate is incorporated into the containership, said pivot bearers thereby serving as guides and bearing for said cylindrical pins of said pivot throw-out dogs which restrict horizontal lateral movement of said respective moveable deck section; wherein at least one of said pivot bearers comprises a groove in said vertical plate which engages said thrust ring of said pivot throw-out dog thereby accommodating horizontal longitudinal forces while restricting horizontal longitudinal movement of said moveable deck section;

two corner bearers located on an opposite sides of said cellular hold section and opposite to said pivot bearers, comprising a flat horizontal plate and brackets connecting said horizontal plate to said containership, four intermediate bearers, located in pairs along said shorter sides of said respective moveable deck sections and symmetrically with respect to a longitudinal central line of the section of the cellular hold of said containership, comprising a flat horizontal plate placed between and connected to two vertical container guides of the vertical container guide system.

4. The system of claim 1, wherein said means for accommodating containers above said moveable deck section comprises a set of elongated bars each having two centering pins and two T-head bolts.

5. The system of claim 2, wherein said pivot throw-out dogs further comprise:

a body having a compartment for housing an elongated bar, said compartment being formed by two parallel vertical plates connected to each other through an upper end with an upper cross bar, said upper cross bar having an angled cut-out portion on one side thereof, wherein said elongated bar comprises a cylindrical end portion inclining into a rectangular central portion at an angle equal to that of said angled cut-out of said upper cross bar of said body, said elongated bar further comprising a pivot opening located away from a center of gravity of said elongated bar thereby urging said elongated bar into a vertical position, said elongated bar further comprising an end with a check stopper opposite said cylindrical end portion so as to arrest said elongated bar in a horizontal position.

6. The system of claim 2, wherein each of said corner throw-out dogs is comprised of:

a body;

a supporting bar;

a bearing for said supporting bar;

a cam cage;

a cam and a camshaft.

7. The system of claim 2, wherein each of said intermediate supports is comprised of:

a body incorporating said throw-out dog and said throw-out guide;

wherein said throw-out dog includes a bearing for said supporting bar, a cam-cage, a cam, and a camshaft; and wherein said throw-out guide includes a bearing for said guiding bar, a cam-cage and a camshaft.

8. The system of claim 2, in which said latching means is comprised of:

a base bolted to said respective movable deck section;

said latch bar including a pivot pin in a middle thereof and said counter weight on an end thereof;

a spring compensating means; and a latch bar arrester.

9. The system of claim 2 in which said stopper means comprises:

a base bolted to said respective portable deck;

said stopper bar, having a pivot pin in a middle thereof and said counterweight on end thereof; and a stopper bar arresting means.

* * * * *